United States Patent [19]

Shell et al.

[11] 4,024,048

[45] May 17, 1977

[54] ORGANOPHOSPHOROUS ANTIFOULANTS IN HYDRODESULFURIZATION

[75] Inventors: Don C. Shell, Richmond; Edward C. Hayward, Houston, both of Tex.

[73] Assignee: Nalco Chemical Company, Oak Brook, Ill.

[22] Filed: Nov. 20, 1975

[21] Appl. No.: 633,956

Related U.S. Application Data

[63] Continuation-in-part of Ser. No. 539,227, Jan. 7, 1975, abandoned.

[52] U.S. Cl. ..... 208/48 AA; 44/72; 44/76; 203/50; 208/213; 208/216; 252/400 A; 260/666.5

[51] Int. Cl.[2] ..... C10G 9/16; C10L 1/26; C23F 14/02; B01D 3/34

[58] Field of Search ..... 208/48 AA, 213, 216; 44/72, 76; 252/400 A

[56] References Cited

UNITED STATES PATENTS

| | | | |
|---|---|---|---|
| 2,899,387 | 8/1959 | Fierce et al. | 208/348 |
| 3,017,357 | 1/1962 | Cyba | 252/32.5 |
| 3,261,774 | 7/1966 | Newkirk et al. | 208/48 |
| 3,516,922 | 6/1970 | Anzilotti | 208/47 |
| 3,558,470 | 1/1971 | Gillespie et al. | 208/48 |
| 3,645,886 | 2/1972 | Gillespie et al. | 208/48 |
| 3,647,677 | 3/1972 | Wolff et al. | 208/48 |
| 3,776,835 | 12/1973 | Dvoracek | 208/48 |

*Primary Examiner*—Delbert E. Gantz
*Assistant Examiner*—G. E. Schmitkons
*Attorney, Agent, or Firm*—Hill, Gross, Simpson, Van Santen, Steadman, Chiara & Simpson

[57] ABSTRACT

Phosphate and phosphite mono- and di-esters and thioesters in small amounts function as antifoulant additives in overhead vacuum distilled gas oils employed as feedstocks in hydrodesulfurizing wherein such feedstocks are subjected to elevated temperatures of from about 200° to 700° F and which are prone under such processing to produce material that deposits and accumulates upon the surfaces of hydrodesulfurization catalysts and also equipment, such as heat transfer surfaces and the like. Such additives not only inhibit and suppress fouling but also reduce fouling in previously fouled such systems.

12 Claims, No Drawings

ORGANOPHOSPHOROUS ANTIFOULANTS IN HYDRODESULFURIZATION

RELATED APPLICATION

This is a continuation-in-part application of our earlier filed U.S. application Ser. No. 539,227, filed Jan. 7, 1975, and now abandoned.

BACKGROUND OF THE INVENTION

In hydrodesulfurization, the overhead vacuum distilled sour gas oils and naphthas employed as feedstocks are prone to produce material that deposits and accumulates upon the surfaces of hydrodesulfurization catalysts and also equipment such as heat transfer surfaces and the like, contacted therewith resulting in the fouling of such catalysts and equipment. In normal, continuous use, for example, the heat exchangers used in such equipment suffer gradually increasing losses in efficiency, heat transfer, pressure drop, and throughout owing to deposition of material on the inner surfaces thereof. Consequently, hydrodesulfurization units must be periodically shut down and the deposite removed therefrom. Such fouling of equipment, such as heat exchangers, furnaces, pipes, chambers, auxiliary equipment, and the like, is costly by reason of the loss of production time and the man hours required for disassembly, cleaning and reassembly of such unit process equipment components. The equipment is usually fabricated of carbon steel, stainless steel, or aluminum.

The catalysts used in hydrodesulfurization are also subject to fouling and contamination, and the equipment must be periodically shut down and the catalyst replaced on this account which adds significantly to operational costs.

The fouling is generally attributed to the presence of unstable components, such as oxidized derivatives of hydrocarbons, the inorganic impurities present in hydrocarbon fractions, organosulfur compounds, the presence of olefinic unsaturated hydrocarbons or their polymeric derivatives, or the like. Thus, characteristically naphthas used as hydrodesulfurization feedstocks contain minor amounts of readily oxidized and oxidizable hydrocarbon constituents. Furthermore, almost all such feedstocks contain amounts of sulfur, dissolved oxygen, and metals, in a free and/or chemically combined state. Chemical and/or thermal treatment of such feedstocks can result in the polymerization of the olefinic substitutes. The fouling deposits themselves are typically and principally polymerization products and are characteristically black in color. Some are initially gummy masses which convert to coke-like masses at elevated temperatures. Inorganic portions of such deposits frequently contain components, such as silica, iron-oxides, sulfur oxides, iron sulfides, calcium oxide, magnesium oxide, inorganic chloride salts, sodium oxide, alumina, sodium sulfate, copper oxides, copper salts, and the like. These deposits are not readily solubilized by common organic solvents and these deposits are distinguishable from the corrosion and sludge formation sometimes occuring in finished products. Conventional antioxidants, stabilizing chemicals, and the like are characteristically relatively ineffective as antifoulants.

The use of certain organophosphorous compounds as antifoulant additives to mineral hydrocarbon mixtures employed as refinery feedstocks undergoing a heat treatment (indluding distillation) has heretofore been proposed. See, for examples, Fierce et al U.S. Pat No. 2,899,387; Cyba U.S. Pat. No. 3,017,357; Newkirk et al U.S. Pat. No. 3,261,774; Koszman U.S. Pat. No. 3,531,394; Gillespie et al U.S. Pat. No. 3,558,470; Gillespie et al U.S. Pat. No. 3,645,886; Wolff et al U.S. Pat. No. 3,647,677; and the like. However, hydrodesulfurization is, as those skilled in the art appreciate, readily distinguishable from other petroleum processing generally by reason of the special conditions, sequences, equipment, catalysts, and coreactants (especially hydrogen) employed. Additives added to upstream precursers of the typical feedstocks used in hydrodesulfurization are typically substantially removed during the upstream processing steps employed (which result in the naphtha distillates used as the hydrodesulfurization feedstocks).

So far as known to us, no one has heretofore ever employed mono and di phosphate or phosphite esters, thioesters, and amine salts thereof, as antifoulant additives for hydrodesulfurization feedstocks. Such phosphorous esters, thioesters and amine salts thereof, have now been found characteristically to display surprising and very useful antifoulant activity in hydrodesulfurization. Not only do these materials inhibit and suppress, and even prevent, fouling when in such feedstocks but also they unexpectedly appear to reduce the fouling in previously used and fouled hydrodesulfurization equipment. Furthermore, these additives also inhibit, suppress and prevent fouling of the catalysts involved without poisoning or adversely affecting catalyst properties, which is a surprising and unusual effect. Such additives in combination can sometimes be considered to be arguably synergistic in some of these effects as those skilled in the art will appreciate. The art of reducing and regulating fouling in hydrodesulfurization without adversely affecting catalysts is very complex and the reasons why a particular antifoulant system works to reduce and regulate fouling without itself harming catalysts are not now known or understood.

BRIEF SUMMARY OF THE INVENTION

In one aspect, this invention relates to an improved process for reducing fouling in hydrodesulfurization during normal and conventional operation conditions of the type using elevated temperatures ranging from about 200° to 700° F., and pressures ranging from about 400 to 500 psig.

This process involves as one step the step of the mixing with a hydrodesulfurization feedstock a small amount of a phosphate and/or phosphite ester material. The phosphate ester compounds employed in this invention are characterized by the general formula:

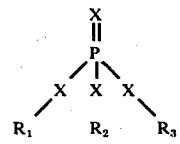

(1)

where:

X is sulfur or oxygen, and $R_1$, $R_2$, and $R_3$ are each individually selected from the group consisting of hydrogen, addition complexes of hydrogen with amines, alkyl, aryl, alkaryl and cycloalkyl, alkenyl, and aralkyl, and provided that, in any given such phosphate ester, at least one and not more than two of each of $R_1$, $R_2$, and $R_3$ are hydrogen or an addition complex of hydrogen with an amine.

The phosphite ester compounds employed in this invention are characterized by the general formula:

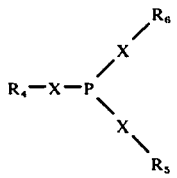

(2)

where:

X is sulfur or oxygen, and $R_4$, $R_5$, and $R_6$ are each individually selected from the group consisting of hydrogen, addition complexes of hydrogen with amines, alkyl, aryl, alkaryl and cycloalkyl, alkenyl, and provided that in any given such phosphite ester at least one and not more than two of each of $R_1$, $R_2$, and $R_3$ are hydrogen or an addition complex of hydrogen with an amine.

A compound of formulas (1) and (2) typically contains from about 1 to 50 carbon atoms per molecule and preferably from about 8 to 20. Presently preferred compounds of formulas (1) and (2) include those wherein X is oxygen, $R_1$ and $R_2$ are each a same or different lower alkyl group, $R_3$ is an addition complex of hydrogen with an amine wherein the amine is a primary amine which contains at least one alkyl group per molecule, and each such amine alkyl group contains from 8 through 14 carbon atoms each $R_4$ is hydrogen, and $R_5$ and $R_6$ are each a same or different lower alkyl group. Formula (1) compounds are preferred over the Formula (2) compounds. As used herein, the term "lower" has reference to a group containing less than 7 carbon atoms each.

The process further involves as another step the heating such a resulting mixture to such elevated processing temperatures (e.g. from about 100° to 1500° F). These steps may be practiced sequentially or simultaneously.

In another aspect, this invention relates to compositions comprising mixtures of a major amount of hydrodesulfurization feedstock with a small amount of at least one compound from formula (1) and (2), and also to such compositions which have been heated to a temperature ranging from about 200° to 700° F. These compositions can be formed in situ during a hydrodesulfurization operation.

DETAILED DESCRIPTION

The Mineral Hydrocarbon Mixture and Processing Thereof

The present invention characteristically may be practiced advantageously with any hydrodesulfurization feedstock, such as an overhead vacuum distilled gas oil, or the like.

Typically, the total amount of formula (1) and/or (2) compound added to a hydrodesulfurization feedstock is less than about 400 parts per million total weight basis. Perferably, the total amount of formula (1) and/or (2) compound admixed with hydrodesulfurization feedstock ranges from about 2 to 50 parts per million (same basis). Hydrodesulfurization processing times can vary considerably, as those skilled in the art of petroleum refining will readily appreciate, but are generally in the range of about 0.5 to 15 minutes, though longer and shorter times can be involved.

As used herein, the term "hydrodesulfurization feedstock" can be considered to have reference to a petroleum composition containing typically at least about 0.2 weight percent (total weight basis) of sulfur usually in a combined form. The total upper amount of sulfur present can vary depending upon the origin of the feedstock, but can be typically in the range of at least from about 4 to 8 weight percent or even higher as those skilled in the art will appreciate. Typically, such a feedstock boils in the range from about 125° to 375° F corrected atmospheric. Typical examples of hydrodesulfurization feedstocks include:

a. residual crude oils having a boiling point in the range from about 550° to 800° F (corrected atmospheric). Such are typically produced by subjecting a crude oil or reduced crude oil to an atmospheric or vaccum distillation (typically involving pressures ranging from about 1 to 5 psiA);

b. naphthas having a boiling point in the range from about 125° to 375° F (corrected atmospheric). Such are typically produced either by coking of residual pitches (developed by first using atmospheric distillation and then vacuum distillation of a crude oil) or by catalytic cracking of virgin and cracked gas oil fractions including atmospheric and vacuum distillates, coker gas oils, and deasphalted oils;

c. gas oils having a boiling point in the range from about 400° to 600° F (corrected atmospheric). Such are typically produced either by atmospheric distillation of crude oil materials (and/or by subsequent vacuum distillation thereof), or by coking;

and the like.

Commonly, such a feedstock also contains at least about 0.2 weight percent nitrogen, usually in a combined form. The total upper amount of nitrogen present can vary depending upon the origin of the feedstock but can be typically in the range of at least from about 0.5 to 1.0 weight percent or even higher as those skilled in the art will appreciate.

Hydrodesulfurization typically involves the following sequential process steps in a petroleum refinery;

A. heating, as in a preheater zone using heat exchangers, a given feedstock to a temperature in the range from about 150° to 550° F (corrected atmospheric), B. admixing with the feedstock a source of hydrogen gas so as to produce a product mixture initially comprised of from about 0.1 to 1.0 parts by weight of hydrogen per 100 parts by weight of the feedstock, C. subjecting such mixture to a pressure of from about 400 to 500 psig while simultaneously contacting said mixture with a hydrodesulfurization catalyst, the mixture temperature concurrently being maintained in the range from about 600° to 700° F., D. passing the resulting such mixture through at least one flashing zone such that the pressure is reduced to a value ranging from about 500 to 25 psig (e.g., generally about atmospheric pressures) and separating a gas phase from a liquid phase, and E. fractionally distilling the resulting liquid phase using an initial liquid phase temperature of from about 200° to 300° F and maintaining during such distillation pressures in the range from about 25 to 50 psig, thereby to reboil and stabilize, typically, such resulting liquid phase by removing therefrom lower boiling fractions thereof developed during step (C) above. The resulting gas phase is further typically processed as follows:

a'. separating a hydrogen rich gas phase from the resulting gas phase, b'. admixing with the resulting hydrogen rich gas phase additional hydrogen so as to produce a charging gas phase containing from about 75 to 85 weight percent hydrogen (total charging gas weight basis), c'. using such charging gas as indicated in step (C) above.

The resulting distilled liquid phase of step (E) above can be used as such, as in a blend with other petroleum derived and produced materials, can be used in a subsequent refinery operation, such as a reforming operation, or can be used as desired all as known to those skilled in this art.

Typical hydrodesulfurization catalysts comprise cobalt, molybdenum, nickel, and combinations thereof. Such catalysts are known to the art and are available commerically under a variety of trade names and trademarks, such as Nalcomo 471, a Trade Mark of Nalco Chemical Company, Oak Brook, Illinois, for a brand of such catalyst. Such catalysts are used in a fixed bed form and preferably have a particle size of from about 1 to 5 mm (broadly generally ranging from about 1/16 to ⅜ inch in diameter, though larger and smaller sizes can be used). Typical liquid hourly space velocities of a mixture through such a catalyst bed in hydrodesulfurization range from about 0.5 to 10 LHSV. The catalyst results in the hydrogen reacting with sulfurous and nitrogeneous impurities to produce $H_2S$ and $NH_3$, as those skilled in the art appreciate.

The sulfur content of the resulting distilled liquid phase is typically at least one order of magnitude less than the sulfur content of the feedstock. Typically the sulfur content of such product liquid phase is not more than about 1 weight percent, and preferably is less than about 0.1 weight percent (total product weight basis).

The nitrogen content of the resulting such product liquid phase is typically likewise at least one order of magnitude less than the nitrogen content of the feedstock. Typically the sulfur content of such product liquid phase is not more than about 0.05 weight percent and preferably is less than about 0.01 weight percent total produce weight basis.

During a hydrodesulfurization procedure carried with a suitable feedstock material containing formula (1) and/or (2) compound(s), such compound(s) is (are) characteristically not carried over in the vapors evolved, but remains instead with the product (e.g. hydrogenated gas oil) involved. Chemical and physical changes may occur, of course, in such additive compound(s) during a given hydrodesulfurization procedure, but it is now theorized (and there is no intent herein to be bound by theory) that any such by-products, degradation products, and the like, are now appreciably carried over with a vapor phase stream removed during a given hydrodesulfurization procedure from a feedstock. Certain of the steps above identified as A through E employed in refinery hydrodesulfurization can be practiced simultaneously, for example, steps B and C can be practiced substantially simultaneously.

Phosphate Compounds

The total number of carbon atoms for each of $R_1$, $R_2$ and $R_3$ can range between about 1 and 50, with a preferred range being from about 8 through 20 carbon atoms per hydrocarbon radical. Typical examples of suitable phosphate esters include (the specific listing of a given monoester here is intended to include the like listing of the corresponding diester as well; thus, for example, methyl phosphate is intended to include dimethyl phosphate but, in instances where the $R_1$, $R_2$, and $R_3$ are not the same, the di-esters are specifically named): methyl phosphate, ethyl phosphate, n-propyl phosphate, isopropyl phosphate, butyl phosphate, pentyl phosphate, hexyl phosphate, cyclohexyl phosphate, heptyl phosphate, nonyl phosphate, decyl phosphate, lauryl phosphate, lorol phosphate, cetyl phosphate, octadecyl phosphate, heptadecyl phosphate, phenyl phosphate, alpha or beta naphthyl phosphate, alpha or beta naphthenyl phosphate, benzyl phosphate, tolyl phosphate, methyl phenyl phosphate, amyl phenyl phosphate, nonylphenyl phosphate, nonyl phenyl phosphate, 4-amylphenyl phosphate, isobutyl phenyl phosphate, nonyltolyl phosphate, di-polyisobutenyl phosphate, di-polyisobutenylphenyl phosphate, polyisobutenylphenyl phosphate, diphenyl phosphate; ethyl phosphate, di-polyisobutenyl, di-polyisobutenyl, and the like.

Typical examples of the phosphate thioesters include p-amylphenyl acid thio phosphate, mono cyclohexyl acid, thio phosphate, diiso decyl acid thiophosphate, mixed isooctyl acid thiophosphate, and the like.

Many of these esters, particularly those containing the smaller number of carbon atoms per molecule, are readily available commercially. Methods of preparation of formula (1) compounds are conventional. Thus, for example, phosphorus pentoxide may be added to a solution of an alcohol in an organic solvent (aromatic solvents being slightly usually preferred over aliphatic solvents because of their more polar character). Examples of suitable solvents include kerosenes, heavy aromatic naphthas, and the like.

The resulting mixture is heated to an elevated temperature to produce reaction. The reaction products are typically soluble and remain in solution. Preferably, reactants are employed in stoichiometric amounts so that relatively pure product solutions are obtained, since the reactions tend to go to completion. Depending upon the particular alcohol reactant or reactants employed, the reaction temperatures used, as well as upon the respective quantities of reactants present, the reaction product is a phosphate ester having one or two alkyl or other hydrocarbonaceous substituents per molecule, as shown in formula (1) above.

A wide variety of alcohol reactants may be employed to realize specific compounds falling within the scope of formula (1). Phosphorus pentoxide is presently preferred as starting phosphorus compounds, but, as those skilled in the art will appreciate, a variety of other phosphorus compounds may be employed, such as phosphoric acid, phosphorus oxychloride, polyphosphoric acid, phosphorus anhydride, and the like.

The reaction product is usually and preferably one which contains at least one acidic hydrogen atom per moleucle which is readily neutralized with a base, preferably for this invention a primary or a secondary amine.

Examples of suitable alcohols include normal, straight chain alcohols such as methanol, ethanol, and those wherein the hydrocarbon portion is n-propyl, n-butyl, n-amyl, n-hexyl, n-hepyl, n-octyl, n-nonyl, n-decyl, n-undecyl, n-dodecyl (lauryl), N-tetradecyl (myristyl), n-hexadecyl (cetryl), and n-octadecyl (stearyl); branched chain primary alcohols such as isobutyl, isoamyl, 2,2,4-trimethyl-1-hexanol and 5,7,7-trimethyl-2-(1,3,3-trimethylbutyl)-1-octanol; and secondary alcohols such as isopropyl, sec-butyl, 2-pentanol, 2-octanol, 4-methyl-2-pentanol, and 2,4-dimethyl-3-pentanol. Examples of alicyclic alcohols are cyclopentanol, cyclohexanol, cycleheptanol, and menthol. Examples of alcohols of the class having ethylenic unsaturation are allyl, crotyl, oleyl (cis-9-octadecen-1-ol), citronellol, and geraniol.

Acetylenic unsaturation is illustrated by propargyl alcohol. Araliphatic alcohols are illustrated by benzyl, 2-phenylethanol, hydrocinnamyl, and alpha-methylbenzyl alcohols. Cinnamyl alcohol is an example of an alcohol containing both aromatic and ethylenic unsaturation.

One excellent source of alcohol which may be used is that class of compounds known as oxo alcohols. These are normally a mixture of various intermediate molecular weight alcohols ranging from 4 to about 16 carbon atoms. Their preparation and description is described in the book *Higher Oxo Alcohols* by L. F. Hatch, Enjay Company, Inc., 1957, which disclosure is hereby incorporated by reference. The general range of both alcohols and ester by-products typifying an oxo alcohol still bottom of the type which may be used in the invention, is as follows:

| Ingredient | Percent |
|---|---|
| Mixed iso-and n-octyl alcohol | 2 - 20 |
| Mixed iso-and n-nonyl alcohol | 5 - 40 |
| Mixed iso-and n-decyl and higher alcohols | 25 - 90 |
| Esters | 20 - 80 |

Examples of suitable thiols include: n butyl mercaptan, cyclohexyl mercoptan, neopentyl mercoptan, benzenethiol and the like.

Examples of suitable amines for salt formation include n-Dodecyl amine; n-Tetradecyl amine; n-Hexadecylamine; lauryl amine, myristyl amine, palmityl amine; stearyl amine; oleyl amine; coconut oil amine; tallow amine; hydrogenated tallow amine; cottonseed oil amine; dilauryl amine; dimyristyl amine; dipalmityl amine; distearyl amine; dicoconut amine; dihydrogenated tallow amine; octyl methylamine; octadecyl methyl amine; hexylethyl amine; soya amine 10%; octadecyl 10%, octadaemyl 35%; octadecadienyl 45%; ethyl amine; diethyl amine; morpholine; butyl amine; isopropylamine; diisopropylamine; N-methyl morpholine; triethylamine; aminoethyl ethanolamine; diethanolamine; diethyl ethanolamine; diisopropanol amine; diemethyl-ethanolamine; dimethyl isopropanolamine; N-hydroxy ethyl morpholine; N-methyldiethanolamine; monoethanolamine; monoisopropanolamine; triethanolamine; triisopropanolamine; 1,1-dihydroxymethyl ethylamine; 1,1-dihydroxymethyl-n-propylamine; polyglycolamine $(H_2NCH_2CH_2\text{-}O\text{-}CH_2CH_2)_nOH$ where $n =$ 1 to 10 inclusive; pyrrolidone; 5-methyl-2-oxazolidone; 2-oxazolidone; imidazole; polyamines of the class

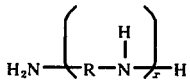

(3)

where

R is an alkylene radical selected from among $-CH_2-CH_2-$, $-CH_2CH_2CH_2-$, and $CH_3-\underset{\underset{CH_3}{|}}{CH}-CH_2-$ and $x$ is an integer of 1–5;

5-benzimidazole; 2-hydroxyethyl imidazole; 2-methyl imidazole; pyrazine; pyridine; piperidine; 2-cyanomethyl-2imidazoline; cyclohexyl amine, and the like.

One preferred class of amines are highly substituted imidazolines such as those defined by one of the following formulas:

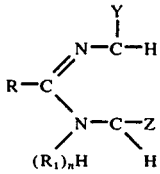

(4)

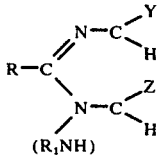

(5)

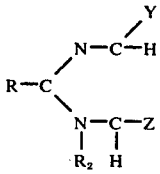

(6)

where in formulas (4), (5), and (6) above R is an aliphatic group of from about 1 to 22 carbon atoms in chain length, Y and Z are selected from the group consisting of hydrogen and lower aliphatic hydrocarbon groups of not more than 6 carbon atoms in chain length, $R_1$ is an alkylene radical of about 1 to 6 carbon atoms, $R_2$ is a radical selected from the group consisting of R and hydrogen, and $n$ is an integer of from about 1 to 50. Imidazolines of the type shown in Formulas (4), (5) and (6) are conveniently prepared by reacting a monocarboxylic acid such as a saturated or unsaturated fatty acid with an alkylene polyamine or hydroxyalkyl alkylene diamine in accordance with well-known methods. The product imidazolines may be further reacted via oxyalkylation to produce other useful derivatives. Methods of preparing imidazolines of this type are given in the article, "The Chemistry of the s-Imidazolines and Imidazolidines", by R. J. Ferm and J. L. Riebsomer, Chemical Reviews, Vol 54, No. 4, Aug., 1954. Particularly useful imidazolines for use in the practice of the invention are those described in Wilson U.S. Pat. Nos. 2,267,965 and 2,355,837. Two typical imidazolines of the type described by the formulas above are 1-(2 hydroxyethyl)-coco imidazoline and 1-(2 hydroxyethyl)-2 tall oil imidazoline, both of which compounds are conveniently prepared using the teachings of Wilson U.S. Pat. No. 2,267,965.

For purposes of illustrating several other types of typical imidazolines that may be used, the following are given by way of example:

1-(2-hydroxyethyl)-2-undecyl imidazoline
1-(2-hydroxyethyl)-2-tridecyl imidazoline
1-(2-hydroxyethyl)-2-pentadecyl imidazoline
1-(2-hydroxyethyl)-2-heptadecyl imidazoline
1-(2-aminoethyl)-2-heptadecyl imidazoline
1-(2-aminoethyl)-aminoethyl-1-2-undecyl imidazoline
1-(2-aminoethyl)-aminoethyl-1-2-tridecyl imidazoline The fatty acids are most generally reacted with a polyalkylene polyamine such as diethylene triamine, triethylene tetramine, tetraethylene pentamine, or mixtures thereof, or a polyamine alcohol such as aminoethyl ethanolamine. The amine may likewise be substituted with lower alkyl groups.

A particularly preferred class of amines are constitutes primary amines. The tertiary-alkyl primary amines have the formula:

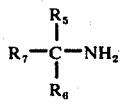

(7)

More specifically, the tertiary-alkyl primary amine constitues a component wherein $R_5$ and $R_6$ are lower alkyl groups, usually methyl groups, and $R_7$ constitutes a long chain alkyl radical composed of 8 to 19 carbons. Tertiary-alkyl primary amines which have been found eminently suitable for the instant invention are "Primene 81-R" and "Primene JM-T". "Primene 81-R" is reported by its manufacturer to be composed of principally tertiary-alkyl primary amines having 11–14 carbons and has a molecular weight principally in the range of 171–213, a specific gravity at 25° C of 0.813, a refractive index of 1.423 at 25° C and a neutralization equivalent of 191. "Primene JM-T" is reported by the manufacturer to be composed of tertiary-alkyl primary amines having 18–22 carbons with a molecular weight principally in the range of 269–325, a specific gravity at 25° C of 1,456 and a neutralization equivalent of 315.

The primary constituent of "Primene 81-R" is reported to be:

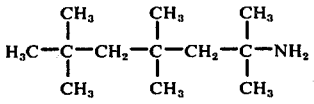

(8)

The primary constituent of "Primene JM-T" is reported to be essentially the same structure as "Primene 81-R", but with 22 carbons. "Primene" is a trademark of the Rohm & Haas Company for its brand of tertiary alkyl primary amines.

Phosphite Compounds

The total number of carbon atoms for each of $R_4$, $R_5$ and $R_6$ can range between about 1 and about 50 with the preferred range being between about 8 and 20 carbon atoms per hydrocarbon radical. Typical examples of suitable phosphite esters include (the specific listing of a given monoester here is intended to include the like listing of the corresponding diester as well; thus, for example, methyl phosphite is intended to include dimethyl phosphite, but in instances where the $R_4$, $R_5$ and $R_6$ are not the same, the diesters are specifically named): methyl phosphite, ethyl phosphite, n-propyl phosphite, isopropyl phosphite, butyl phosphite, pentyl phosphite, hexyl phosphite, cyclohexyl phosphite, heptyl phosphite, nonyl phosphite, decyl phosphite, lauryl phosphite, lorol phosphite, cetyl phosphite, octadecyl phosphite, heptadecyl phosphite, phenyl phosphite, alpha or beta naphthyl phosphite, alphas or beta naphthenyl phosphite, benzyl phosphite, tolyl phosphite, methyl phenyl phosphite, amyl, phenyl phosphite, diamyl phenyl phosphite, nonylphenyl phosphite, isobutyl phenyl phosphite, nonyltolyl phosphite, di-polyisobutenyl phosphite, di-polyisobutenylphenyl phosphite, polyisobutenylphenyl phosphite, diphenyl phosphite, di-polyisobutenyl, di-polyisobutenyl, and the like.

Typical thiophosphite esters include diethyl hydrogen thiophosphite, dibenzyl hydrogen thiophosphite, mono secondary butyl dihydrogen thiophosphite, di tertiary butyl hydrogen thiophosphite, and the like.

Many of these esters, particularly those containing a small number of carbon atoms per molecule, are readily available commerically. Methods of preparation are conventional. Some of these esters, particularly those having the longer alkyl chains although presently not available commercially, are readily prepared by reacting one, two, or three moles of the corresponding alcohol or phenol with each mole of a phosphorus trihalide, such as phosphorus trichloride or phosphorus tribromide. This is a conventional reaction and there are other ways, also conventional, of producing these various phosphite esters. Thus, desired organophosphites may be conveniently prepared by direct esterization of phosphorous acid with alcohol.

The present invention is not concerned with the particular method by which the phosphite esters or phosphate esters are produced. In those cases where mono- or di-esters are formed, it is sometimes desirable, following the esterification reaction, to treat the reacted mixture with water, dilute aqueous caustic, or dilute aqueous mineral acid in order to hydrolyze off the residual chlorine of bromine atoms presently by reason of the particular trivalent or pentavalent phosphorus compound employed as an original reactant. For purposes of the present invention, amine salts of phosphite esters and thiophosphite esters do not appear to be as active antifoulants as do other materials of formulas (1) and (2).

Mixing and the Compositions

Only relatively small amounts of compounds of formulas (1) and/or (2) are ued to produce a reduction both in fouling deposits, and/or a suppression of fouling in the typical practice of this invention. Preferably, the total amount of such compounds present in a total mixture ranges from about 2 to 50 parts per million by weight, and more preferably ranges from about 4 to 10 parts per million, though larger and smaller amounts of such compounds may be employed, as those skilled in the art will appreciate. Owing to the complexity of the variables involved, it is not possible to indicate optional concentrations of additives for all possible use situations.

Mixing of formula (1) and/or formula (2) compound(s) with hydrodesulfurization feestock can be accomplished by any convenient or conventional means before or during a hydrodesulfurization operation. Typically, compound(s) of formula (1) and/or (2) are injected continuously into a feedstream through a chemical feed pump or the like ahead of hydrodesulfurization equipment. Preferably, injection takes place before such equipment rather than in such equipment. To assure substantially complete dispersion, a suitable injection point should be selected, such as into the suction region of a charge pump. Sleeve type arrangements termed "quills" may be preferably used to inject compound(s) of formula (1) and/or (2) continuously into a line transporting a feedstream to cause good mixing.

The compound(s) of formula (1) and/or (2) are preferably so fed in a previously prepared solution form using a solvent liquid which is soluble or miscible with the hydrodesulfurization feedstream being treated. When large pump feeding rates are involved, one may employ more dilute solutions than at lower pumping rates.

The solvent used for such a solution of compound(s) of formula (1) and/or (2) can vary widely. In general, such should have a higher boiling point than that of the more volatile components of the feedstream into which the resulting solution is to be injected. A presently preferred type of solvent is one which has a boiling point in the range from about 350° to 550° F., such as a heavy aromatic hydrocarbon mixture (of a type derived from petroleum refining). Preferably, such solvent itself has a sulfur content not greater than about 1 weight percent (based on total solvent weight). Typically and preferably such a solvent is comprised of at least 90 weight percent (total solvent weight basis) of six membered aromatic rings which may each be substituted by at least one alkyl group having from 3 through 7 carbon atoms each, as those skilled in the art will appreciate. The total amount of formula (1) and/or (2) compound(s) dissolved a given such solvent can vary widely, but usually and conveniently this amount falls in the range of from about 10 to 40 combined weight precent of formula (1) and/or (2) compound(s) per 100 weight percent total solution. Neither the solvent nor the solute appears to affect generally the useful properties either of a feedstream to which such a solution is added, or the desulfurized product which may contain residual materials derived from such a solution.

When formula (1) and/or (2) compound(s) is (are) fed to a feedstream having an initial temperature above about 200° F, it is preferred to have a nipple connecting the feedline to the process line which is made of stainless steel. For best results, the hydrodesulfurization equipment is preferably initially thoroughly cleaned, most preferably by mechanical means.

Starting charge dosages of formula (1) and/or formula (2) compound(s) are preferably greater than subsequent dosages during continuous equipment operation. Thus, in one preferred mode of practicing this invention, at a given injection point, an initial dosage rate of from about 2 to 50 parts per million of a formula (1) and/or (2) compounds is (are) mixed with a feedstream. After an initial operational period of, for example, about 1 to 2 weeks, this dosage rate can be reduced to a level of from about 5 to 20 parts per million. Thereafter, for an extended operating period, the level of fouling, or the rate of fouling, in hydrodesulfurization equipment, surprisingly does not appear to change substantially and remains substantially below the level of fouling associated with hydrodesulfurization feedstocks which are not admixed with formula (1) and/or (2) compound(s). Such an antifouling maintenance procedure appears to be new in this art and represents one of the advantages of the present invention. The reason why such a non-fouling effect is achieved with such reduced dosage rates (compared to starting dosage rates) is not known, but it is theorized that this effect may possibly be associated with micellular agglomerates building up on the inside surfaces of hydrodesulfurization equipment contacted with a formula (1) and/or (2) compound(s).

Also, in another preferred mode of practicing the present invention, at least one compound of formula (1) and/or (2) is mixed simultaneously with a hydrodesulfurization feedstock being processed at various successive locations therealong. For example, such a compound can be first injected into and mixed with a feestock before such undergoes the initial heating which is identified above as step (A). Thereafter, and simultaneously, such material may also be injected into a process stream before each of the steps identified above as steps (B) through (E) using a same or similar rate of addition at each injection location. If such material is not so injected at each such location, it is preferred to inject such at least before steps (A), (C), and (E).

The compounds of formula (1) and/or (2) operate in a manner not altogether clear, and, while there is no intent to be bound by theory herein, it is theorized that such compounds may function to reduce fouling by retarding organic polymer formation and also by dispersing organic and inorganic sludge-like material which would otherwise build up on heated equipment sufaces. Build up rates of deposits of fouling material on interior surfaces of hydrodesulfurization processing equipment is usually such that months or even years of actual operation time may be involved before a shut down is forced for reasons associated with a build up to fouling deposits, but those skilled in the art will appreciate that fouling in hydrodesulfurization can occur rapidly, so that equipment operational failure can occur in a matter of even days under conditions of heavy fouling. The compound(s) of formula (1) and/or formula (2) are well suited for use with heat transfer surfaces of ferrous metals (such as stainless steel or carbon steel) or of aluminum. The compounds of formula (1) and formula (2appear to be particularly effective as antifoulants at the tube wall temperatures below about 1200° F and at oil temperatures below about 600° to 950° F though they can be used as antifoulants at higher temperatures, as taught herein.

In another preferred mode of practicing this invention compound(s) of formula (1) and/or (2) is (are) added to a hydrodesulfurization feedstock being processed in previously fouled hydrodesulfurization equipment, as taught herein, and reduction in the fouling of such previously fouled refinery equipment is characteristically achieved by this invention. Such a reduction is shown in such ways as reduced pressure drop across a given unit or zone, increased temperature (better heat transfer) across a given unit (such as a heat exchanger) or zone, reduced furnace fuel consumption, and the like. Surprisingly, when an additive of this invention is mixed with hydrodesulfurization feedstocks in the processing thereof as taught herein, but employing refinery equipment which is already at least partially fouled, a reduction in fouling rates and even in already formed fouling deposits, can be observed, as indicated.

After being heat processed at temperatures ranging from about 200° to 700° F, a composition of this invention which is initially comprised of hydrodesulfurization feedstock and compound(s) of formula (1) and/or (2) appears to have undergone chemical change but the exact nature of such change is not now know. For one thing, differential thermal analysis of certain heated compositions comprising hydrodesulfurization feedstock with a compound of formula (1) or (2) above suggests that there is a possibility that such a compound of formula (1) or (2) undergoes some sort of decomposition or change in structure at temperatures below those occuring in the hotter process zones utilized in hydrodesulfurization.

Compound(s) of formula (1) and/or (2) in admixture with hydrodesulfurization feedstocks appear to exert no harmful effects on catalysts of the type used in hydrodesulfurization operations. Thus, for example, when amine salts of mixed octyl phosphates are used on a typical desulfurization catalyst (available from Nalco Chemical Company, Oak Brook, Ill., under the trademark "Nalcomo 471") in a test where such phosphate ester is applied at 50 ppm for a simulated six month continuous run, only about 1% desulfurization loss results. Furthermore, this phosphate ester appeared to have no detrimental effect on catalyst regeneration. This effect is surprising and unexpected and constitutes a significant advantage of the present invention.

A primary advantage of this invention is the circumstance that compounds of formulas (1) and (2) can be used under hydrodesulfurization conditions to inhibit, suppress, and reduce fouling without substantial interference with (e.g. poisoning or the like) hydrodesulfurization catalyst activity.

EMBODIMENTS 1

The present invention is further illustrated by reference to the following Examples. Those skilled in the art will appreciate that other and further embodiments are obvious and within the spirit and scope of this invention from the teachings of these present Examples taken with the accompanying specification.

EXAMPLE 1

To a clean dry, nitrogen blanketed 2-liter stainless steel reactor provided with an efficient stirrer and a water-cooled, steam-heated jacket is charged 778 grams of mixed xylenes as an aromatic hydrocarbon solvent system. Agitation is started and 390 grams of isooctanol is added. To the resulting agitated solution is added 142 grams of phosphorus pentoxide, thereby to form a slurry in which the phosphorus pentoxide is suspended as fine particles. The temperature of the reactor is raised to about 140° C and held at this temperature for about 2 hours at which point the system characteristically is clear in appearance. The reactor is then cooled to 60° C. The product is a solution of mixed octyl phosphates in aromatic hydrocarbon solvent.

To this product solution is added with stirring 246 grams of "Primene 81-R". "Primene 81-R" is a trademark of the Rohm & Haas Company for its brand of principally tertiary-alkyl primary amines having 11–14 carbons which have a molecular weight principally in the range of 171–213, a specific gravity at 25° C of 0.813, a refractive index of 1.423 at 25° C and a neutralization equivalent of 191. The resulting product is a 50 weight percent solution of amine salt of mixed octyl phosphates in mixed xylenes.

EXAMPLES 2–4

Using the procedure of Example 1, a series of various phosphate ester solutions within the scope of formula (1) above are prepared. The reactants with phosphorus pentoxide and the reaction products are summarized below in Table 1 in each case.

TABLE I

| Ex. No. | Alcohol Reactant | Qty | Reaction Product |
|---|---|---|---|
| 2 | n Butyl Alcohol | 222 | Mixed Butyl Phosphates |
| 3 | n Decyl Alcohol | 474 | Mixed Decyl Phosphates |
| 4 | 1,10 Decanediol | 177 | 1,10 Decamethylene Diphosphate |

EXAMPLES 5 & 6

A series of various mono and di phosphite esters within the scope of formula (2) above are prepared. The preparation procedure encompasses reacting stoichemetric molar quantities of the corresponding alkanol with one mole of $PCl_3$ under reflux conditions and until no further amounts of hydrogen chloride are evolved. Theraeafter, to accomplish substantially complete hydrolysis, the appropriate number of moles of water are added to the reaction mixture. The reactants with phosphorus trichloride and the reaction products are summarized below in Table II in each case.

TABLE II

| Ex. No. | Alcohol Reactant | Qty. of $PCl_3$ | Qty of Water Used For Hydrolysis | Reaction Product |
|---|---|---|---|---|
| 5 | ethanol (276g) | 412.5g | 54g | Diethyl Hydrogen Phosphite |
| 6 | butanol (222g) | 412.5g | 108g | Mono Butyl Hydrogen Phosphite |

EXAMPLE 7

Antifouling Evaluation Apparatus and Procedure

Apparatus for accelerated fouling test comprises a feed tank, a nitrogen pressurizing system, a valve and rotameter to control the flow of feed stock from the fuel tank to the heater section and the waste tank, and a heater section which consists of an annular single tube heat exchanger through which the feed stock flows and is heated to field process temperatures. Flow from the feed tank to the waste tank by way of the heat exchanger is accomplished by maintaining the pressure in the waste tank lower than that of the feed tank.

A feedstock entering at the bottom of the exchanger system is at room temperature and the desired pressure. As the feed travels up the exchanger, it is heated to progressively increasing temperatures ranging from about 100° F to about 1000° F. During this rapid change in heat content, the feedstock degrades as it slowly passes through the heat exchanger, forming particles which tend to adhere to the exchanger inside surfaces.

The deposits thus formed on the inner walls of the heat exchanger tube in such apparatus depend on the nature of the feedstock and the temperatures applied thereto. Both skin temperature and fluid temperature are significant factors. These deposits may range from a yellow-brown gum or light varnish in the vicinity of the relatively cool end of the tube, to heavy coke at the relatively hot end. The type of deposit on each distinguishable area on the tube is rated visually according to some system, such as the following system:

| Variety of deposit: | Rating No. |
|---|---|
| Clear tube | 0 |
| Tube rainbowing or golden yellow | 1 |
| Light layer of varnish | 2 |
| Medium layer of varnish | 3 |
| Heavy layer of varnish, light coke layer | 4 |
| Moderate layer of coke | 5 |
| Heavy layer of coke | 6 |

Following this visual rating, the rating number assigned to each distinguishable area on the tube is squared and multiplied by the average length of that area. These numbers are added to give a total rating number for each test.

This procedure is illustrated in the following example:

| Type of Deposit | Light Varnish | | Medium Varnish | | Light Coke | | Heavy Coke | |
|---|---|---|---|---|---|---|---|---|
| Rating | 2 | | 3 | | 4 | | 6 | |
| Inches | 4 | | 2 | | 6 | | 1 | |
| | $(2)^2 \times 4$ | + | $(3)^2 \times 2$ | + | $(4)^2 \times 6$ | + | $(6)^2 \times 1$ | |
| | 16 | + | 18 | + | 96 | + | 36 | =166 |

This rating system emphasizes the quality and quantity of coke formed from the thermal decomposition of the feedstock and at the same time takes into account deposits formed from gums which are already present in the stock or which form during the heating process.

The test conditions chosen were typical of those encountered in refinery heat exchangers.

Using such apparatus and procedure, there is employed a coker naphtha as the feedstock. Various additives are evaluated. The additives used, the rates of use, and the results are as recorded in Table III below:

TABLE III

| Ex. No. | Additive | Amount Additive Admixed p.p.m. | Tube Rating | % Fouling Reduction (compared) to control) |
|---|---|---|---|---|
| 7.a | untreated control | | 130 | additive-free |
| 7.1 | $H_3PO_4$ | 300 | | fouling reduced |
| 7.2 | $H_3PO_4$-Primene 8IR - Salt | 300 | | fouling reduced |
| 7.3 | Decyl Acid Phosphate | 300 | 9 | 92 |
| 7.4 | Decyl Acid Phosphate-Primene JMT Salt | 225 | 40 | 62 |
| 7.5 | p-Amylphenyl Acid Thiophosphate | 150 | 9 | 92 |
| 7.6 | Ibid - Primene JMT Salt | 300 | 25 | 80 |
| 7.7 | $H_3PO_3$ | | | fouling reduced |
| 7.8 | $H_3PO_3$-Primene 81R - Salt | 500 | 56 | 45 |
| 7.9 | Diethyl Hydrogen Phosphate | 150 | 15 | 90 |
| 7.10 | Octyl Acid Phosphite | 500 | 31 | 73 |
| 7.11 | Mixed Octyl Acid Phosphite-Primene 81R Salt | 500 | 85 | 27 |

The preceding evaluation results demonstrate that compounds within the scope of each of formulas (1) and (2) are useful as antifoulants in hydrodesulfurization, especially in the low pressure separator and in the fractionator thereof.

EXAMPLE 8

Using the same apparatus and procedure of Example 7, some of the same additives are retested with the same feedstock, but using reduced rates of additive addition of feedstock which rates are similar to those employed in commerical refinery operations. The additives used, the rates of use, and the results are indicated in Table IV below. It is noted that the higher rates of additive addition to feedstock used in Example 7 are employed because of the accelerated nature of the test procedure; thus, the higher rates are useful in indicating and determining whether or not a particular additive is effective as an antifoulant in hydrodesulfurization operations.

TABLE IV

| Ex. No. | Additive | Amount Additive Admixed p.p.m. | Comment Relative to Untreated Control |
|---|---|---|---|
| 8.1 | $H_3PO_4$ | 10 | fouling reduced |
| 8.2 | Decyl Acid phosphate Primene JMT Salt | 10 | fouling reduced |
| 8.3 | p-Amylphenyl Acid Thiophosphate | 10 | fouling reduced |
| 8.4 | Diethyl Hydrogen Phosphite | 10 | fouling reduced |
| 8.5 | Mixed Octyl Acid Phosphate Primene 81R Salt | 10 | fouling reduced |

EXAMPLE 9

Using the same apparatus and procedure of Example 7, certain other additives are evaluated. The additives used, the rates of use and the results are indicated in Table V below.

TABLE V

| Ex. No. | Additive | Amount Additive Admixed p.p.m. | Comment (Relative to Untreated Control) |
|---|---|---|---|
| 9.1 | Primene 81-R Amine Salt of Mixed Octyl Phosphate (1) | 100 | fouling reduced |
| 9.2 | (same as 9.1) | 3 | fouling reduced |
| 9.3 | Mixed Butyl Phosphates (2) | 300 | fouling reduced |
| 9.4 | Mixed Decyl Phosphates (3) | 300 | fouling reduced |
| 9.5 | 1,10 Decamethylene diphosphate (4) | 300 | fouling reduced |
| 9.6 | Monobutyl Hydrogen Phosphite (5) | 300 | fouling reduced |

(1) Material of type prepared in Example 1
(2) Material of type prepared in Example 2
(3) Material of type prepared in Example 3
(4) Material of type prepared in Example 4

The preceding results indicate that compounds of formulas (1) and (2) are useful in the low pressure separator and in the fractionator of a hydrodesulfurization operation.

EXAMPLE 10

Using the same apparatus and procedure of Example 7 except that in place of the coker naphtha there is employed as a feed stock the following materials:

a. sour heavy FCCU naphtha,
b. a sour virgin naphtha feed stock, and
c. reduced sour crude oil, These evaluations are summarized in Table VI below:

TABLE VI

| Ex. No. | Additive | Feedstock (Particular Feedstock As Indicated In Text) | Amount Additive Admixed With Feedstock (ppm) | Comment (Relative To Untreated Control Of Same Feedstock) |
|---|---|---|---|---|
| 10.1 | Primene JMT amine salt of p amyl phenyl acid thiophosphate | (b) | 3 | fouling reduced |
| 10.2 | decyl acid phosphate and p amyl phenyl acid thiophosphate (1:1 weight ratio) | (c) | 300 | fouling reduced |
| 10.3 | diethyl hydrogen phosphite | (a) | 300 | fouling reduced |

The results demonstrate that compounds of formulas (1) and (2) are useful in hydrodesulfurization operations.

EXAMPLE 11

A sour naphtha having a boiling range of about 125° to 375° F., a sulfur content of about 1.0 weight percent, and a nitrogen content of about 0.2 weight percent is used as a starting material. Unless otherwise indicated in these Examples, boiling temperature ranges are expressed in corrected atmospheric values and weight percentages are expressed on a total compositional weight basis (for each composition involved). This naphtha is derived by atmospheric fractional distillation of a desalted refinery battery limit mid continent sour crude oil mixed with an estimated quantity of from about 0.1 to 1.0 parts by weight of hydrogen gas per 100 parts by weight of such naphtha. The hydrogen is contained in a feed gas which, in turn, is comprised of about 80 weight percent (total gas weight basis) of hydrogen. The feed gas is formulated of make-up hydrogen and recycle gas.

The mixture is charged to a hydrodesulfurization preheater (a heat exchanger bank and a furnace) and is thereby heated to a temperature ranging from about 200° to 700° F.

The heated mixture is charged to a high pressure reactor of the continuous flow through type having a fixed catalyst bed of granules about ¼ inch in average diameter comprised of a cobalt/molybdenum catalyst (available commercially from Nalco Chemical Company under the trade designation NALCOMO 471.) The liquid hourly space velocity is in the range of from about 0.5 to 4.0. The pressure is maintained in the range from about 400 to 500 psig and the temperature (feedstream input) is maintained in the range from about 650° to 700° F.

The effluent from this reactor is continuously fed to a high pressure separation (flash chamber) wherein the hydrogen rich gas is flashed from the reaction product thereby producing a separator gas phase and a separator liquid phase. This separator serves to reduce the pressure of the reaction product to 200 psig.

The separator liquid is then continuously fed into a low pressure separator (flash chamber) to remove $H_2S$ and fuel gas therefrom. The resulting separator liquid which has a temperature of about 150° F is then directly charged to a fractional distillation column (an atmospheric stabilizer wherein naphtha boiling in the range from about 150° to 300° F, middle distillate boiling the range from about 250° to 425° F., and fuel oil boiling in the range from about 300° to 550° F are separated. These condensates and the residue can be further processed and/or used as desired.

The separator gas is purifed prior to recycling to the high pressure reactor.

The condensates, and the residue from the fractionator each have sulfur contents of about 0.02 weight percent (total respective fractional product weight basis) and nitrogen contents of about 0.01 weight percent (same basis).

The stabilizer used is equipped with numerous trays through which the hydrocarbon vapors pass in an upward direction. Each tray contains a layer of liquid through which the vapors can bubble and the liquid can flow continuously by gravity in a downward direction from one tray to the next one below. As the vapors pass upward through the succession of trays, they become lighter (lower in molecular weight and more volatile), and the liquid flowing downward becomes progressively heavier (higher in molecular weight and less volatile). This counter-current action results in a fractional distillation or separation of hydrocarbons based on their boiling points. Liquids are withdrawn from preselected trays as a net product, the lighter liquids such as naphtha being withdrawn from trays near the top of the column, and the heavier liquids, such as diesel oil, being withdrawn from the trays near the bottom. The boiling of the net product liquid depends on the tray from which it is taken. Vapors containing the lighter hydrocarbons are withdrawn from a top region of the distillation column as a net product, while a liquid stream boiling higher than about 200° F is removed from a bottom region of the distillation column.

This hydrodesulfurization arrangement is equipped with a series of sleeve-type arrangements termed "quills" for purposes of injecting additives into the process streams involved. Thus, one quill is located in the feed line to the pre-hydrodesulfurization heat exchanger (termed in Table VIII quill No. 1). Another quill is located in the line between this heat exchanger and the high pressure reactor (termed quill No. 2). Another quill is located in the line between the high pressure reactor and the high pressure separator (termed quill No. 3). Another quill is located in the line between the high pressure separator and the low pressure separator (termed quill No. 4). Another quill is located in the line between the low pressure separator and the fractionator (termed quill No. 5).

A series of solutions are prepared of various additive compounds of formula (1) and formula (2) above. The solvent in all cases is generally a heavy aromatic hydrocarbon (petroleum derived) having a boiling point in the range of from about 300° to 650° F. The additives used and the concentration of such additives in each respective solution are summarized in Table VII below.

The equipment train here involved has a capacity to process at least about 1,000 barrels of hydrodesulfurization feedstock. Before being equipped with quills as above described, this equipment had been in use for a period of time in excess generally of about 3 months and the interior walls of substantially all of the pieces of equipment involved were known to carry substantial fouling deposits thereon. The hydrodesulfurization catalyst is also known to be fouled with fouling deposits.

Various individual solutions as above described are injected into the various process streams which are quill equipped as above described at specified rates of injection for specified intervals of time at the end of which the equipment downstream from the point of injection is investigated to determine the extent of fouling or the condition of fouling associated therewith. Such condition is then compared to the starting condition. Details and results are tabularized in Table VIII below, for convenience. As Table VIII indicates, the compounds of formula (1) and of formula (2) are effective in controlling and in actually reducing the fouling of internal refinery equipment surfaces. Reduction in fouling of previously fouled equipment and also of hydrodesulfurization catalyst is demonstrated by a decrease in pressure drop or an increase in temperature at a given process stream point achieved as well as by a reduction in product sulfur content after use as described in this Example of additives of this invention for periods of 20 to 30 days. The fact that the hydrodesulfurization catalyst is substantially unaffected by the compounds of formula (1) and (2) as respects catalyst activity is demonstrated by the actual decrease in sulfur content in a condensate product compared to the sulfur content of the same product in the same apparatus but before addition of compounds of formulas (1) and (2) is commensed.

Table VII

| Ex. No. | Additive Type | Concentration of additive in solution (wt.%) | Solvent (characterization) for each solvent given by footnotes) |
|---|---|---|---|
| 11a | Mixed Octyl Phosphate-Amine Salt | 20 | Exxon Heavy Aromatic Solvent[1] |
| 11b | Mixed Ethyl | 10 | Texaco Aromatic |

Table VII-continued

| Ex. No. | Additive Type | Concentration of additive in solution (wt.%) | Solvent (characterization) for each solvent given by footnotes) |
|---|---|---|---|
| | Phosphite | | Solvent[2] |

[1]90 – 95% Aromatics, Boiling Range 318 – 600° F
[2]95 – 98% Aromatics, Boiling Range 401 – 662° F

TABLE VII

| Ex. No. | Additive Solution No. | Total Additive Conc. in PPM based on initial crude charge rate | Quills where added 1 | 2 | 3 | 4 | 5 | 6 | 7 | total time additive so added at each quill | fouling results |
|---|---|---|---|---|---|---|---|---|---|---|---|
| 11.1 | 13a | 20 | 20 | — | — | — | — | — | — | 6 mo | Fouling reduced |
| 11.2 | 13b | 30 | — | 15 | — | 15 | — | — | — | 9 mo | |
| 11.3 | 13a | 40 | 10 | — | 10 | — | 10 | — | 10 | 1 yr | |
| 11.4 | 13b | 50 | 25 | — | — | — | — | 25 | — | 15 mo | |
| 11.5 | 13a | 30 | — | — | 10 | 10 | 10 | — | — | 4 mo | |
| 11.6 | 13b | 15 | — | — | — | 15 | — | — | — | 6 mo | |
| 11.7 | 13a | 40 | 20 | — | 20 | — | — | — | — | 9 mo | |
| 11.8 | 13b | 45 | 10 | 10 | 10 | — | 10 | — | 5 | 1 yr | |

EXAMPLE 12

An equipment train similar to that described above in Example 10 is employed except that here such train is previously cleaned of all fouling deposits before being used. The high pressure reactor is charged with new hydrodesulfurization catalyst. The procedures are identical to those described in Example 10. The results are described below in Table IX. As Table IX indicates, the compounds of formulas (1) and (2) are effective in controlling and in substantially preventing the fouling of internal refinery equipment surfaces without affecting apparently catalyst activity. Prevention of fouling is demonstrated by maintenance of substantially constant pressures and temperatures at given process stream points over prolonged periods of time (e.g. in excess of 60 days) when additives of this invention are used in the process streams as indicated in Table IX. See Footnotes for measurements and times.

TABLE IX

| Ex. No. | Additive Solution No. | Total Additive Conc. in ppm based on initial crude charge rate | Quills where added 1 | 2 | 3 | 4 | 5 | 6 | 7 | total time additive so added at each quill | fouling results |
|---|---|---|---|---|---|---|---|---|---|---|---|
| 12.1 | 13a | 20 | 20 | — | — | — | — | — | — | 8 mo[1] | Fouling reduced |
| 12.2 | 13b | 30 | — | 15 | — | 15 | — | — | — | 13 mo | |
| 12.3 | 13a | 40 | 10 | — | 10 | — | 10 | — | 10 | 1 yr | |
| 12.4 | 13b | 50 | 25 | — | — | — | — | 25 | — | 2 yrs[2] | |
| 12.5 | 13a | 30 | — | — | 10 | 10 | 10 | — | — | 6 mo | |
| 12.6 | 13b | 15 | — | — | — | 15 | — | — | — | 9 mo | |
| 12.7 | 13a | 40 | 20 | — | 20 | — | — | — | — | 11 mo[3] | |
| 12.8 | 13b | 45 | 10 | 10 | 10 | — | 10 | — | 5 | 15 mo | |

[1]No measurable increase in pressure drop across catalyst bed during this period
[2]Run length extended 6 months beyond normal as limited by furnace tubewall temperatures
[3]Preheat exchangers substantially free from fouling when inspected at routine unit turnaround

We claim:

1. In a method for reducing fouling of surfaces contacted with hydrodesulfurization feedstocks during hydrodesulfurization thereof without adversely affecting hydrodesulfurization catalysts, said hydrodesulfurization comprising a successive series of continuously practiced steps including:

A. heating a hydrodesulfurization feedstock to a temperature in the range from about 200° to 700° F, B. admixing with said feedstock a source of hydrogen gas so as to produce a product mixture initially comprised of from about 0.1 to 1.0 parts by weight of hydrogen per 100 parts by weight of said feedstock, C. subjecting said mixture simultaneously to a pressure of from about 400 to 500 psig and a temperature in the range from about 650° to 700° F, while contacting said mixture with a hydrodesulfurization catalyst, D. exposing the product system to a least one flashing zone such that the pressure thereof is reduced to a value ranging from about 10 to 50 psig and separating the resulting gas phase from the resulting liquid phase, and E. fractionally distilling said resulting liquid phase using an initial liquid phase temperature from about 200° to 350° F and maintaining during such distillation pressure in the range from about 10 to 50 psig, thereby to remove from said resulting liquid phase lower boiling fractions developed during step (C) above, the improvement which comprises the steps of:

a. admixing at least one material selected from the group consisting of said hydrodesulfurization feedstock, said mixture, said product system, and said liquid phase, a small amount of at least one additive preceding at least one of the respective said processing steps in said series designated above as (A) through (E) and thereafter b. subjecting said resulting mixture to the remaining successive process steps in said series, said additive being at least one compound selected from the group consisting of phosphate esters, thiophosphate esters, phosphite esters, and thiophosphite esters, said phosphate esters and said thiophosphate esters being characterized by the general formula

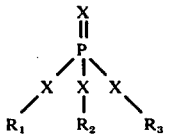

where:

X is sulfur or oxygen $R_1$, $R_2$, and $R_3$ are each independently selected from the group consisting of hydrogen, and addition complex of hydrogen with an amine, alkyl, aryl, alkaryl, cycloalkyl, alkenyl, and aralkyl provided that in any given such phosphate ester at least one and not more than two of each of $R_1$, $R_2$ and $R_3$ are hydrogen or an addition complex of hydrogen with an amine, and said phosphite esters and said thiophosphite esters being characterized by the general formula

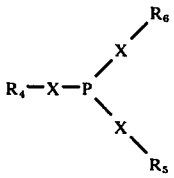

where:

X is sulfur or oxygen $R_4$, $R_5$, and $R_6$ are each independently selected from the group consisting of hydrogen, an addition complex of hydrogen with an amine, alkyl, aryl, alkaryl, cycloalkyl, alkenyl, and aralkyl, provided that in any given such phosphite ester at least one and not more than two of each of $R_4$, $R_5$, and $R_6$ are each hydrogen or an addition complex of hydrogen with an amine.

2. The process of claim 1 wherein each of said phosphate compounds is so mixed at a rate of from about 2 to 50 parts per million by weight with said material.

3. The process of claim 1 wherein each of said phosphite compounds is so mixed at a rate of from about 2 to 50 parts per million by weight with said material.

4. The process of claim 1 wherein from about 2 to 50 parts per million of said additive (total additive weight basis) are admixed with said material.

5. The process of claim 1 wherein said additive is first dissolved in a heavy aromatic hydrocarbon having a boiling point in the range from about 350° to 550° F before being admixed with said material.

6. The process of claim 1 wherein said additive is so admixed preceding at least two of said respective processing steps.

7. The process of claim 1 wherein said surfaces so contacted are preliminarily fouled with deposits from hydrodesulfurization feedstock during hydrodesulfurization.

8. The process of claim 1 wherein, in such a phosphate compound $R_1$ and $R_2$ are each lower alkyl, and $R_3$ is a hydrogen addition complex with an amine.

9. The process of claim 1 wherein, in such a phosphite compound, $R_4$ and $R_5$ are each lower alkyl, and $R_6$ is hydrogen.

10. The process of claim 1 wherein at least one of said phosphate esters is so admixed in combination with at least one of said phosphite esters.

11. The process of claim 1 wherein said phosphate compound is either mixed octyl phosphate amine salt or a mixed butyl phosphate amine salt.

12. The process of claim 1 wherein said additive is initially continuously admixed at a rate of from about 2 to 50 parts per million and, then, thereafter, following a period of such admixture of at least about 1 week, said additive is continuously admixed at a rate of from about 5 to 20 parts per million for a period in excess of 1 week.

* * * * *